US010758036B2

(12) United States Patent
Lu

(10) Patent No.: US 10,758,036 B2
(45) Date of Patent: Sep. 1, 2020

(54) ADJUSTABLE TABLE LEG

(71) Applicant: Dong Guan Song Wei Electric Technology Co., Ltd., Dongguan, Guangdong (CN)

(72) Inventor: Weilin Lu, Dongguan (CN)

(73) Assignee: DONG GUAN SONG WEI ELECTRIC TECHNOLOGY CO., LTD., Dongguan, Guangdong (CN)

( * ) Notice: Subject to any disclaimer, the term of this patent is extended or adjusted under 35 U.S.C. 154(b) by 66 days.

(21) Appl. No.: 16/136,242

(22) Filed: Sep. 19, 2018

(65) Prior Publication Data

US 2020/0085184 A1 Mar. 19, 2020

(51) Int. Cl.
*A47B 9/04* (2006.01)
*A47B 9/20* (2006.01)

(52) U.S. Cl.
CPC ..... *A47B 9/20* (2013.01); *A47B 9/04* (2013.01); *A47B 2200/0054* (2013.01); *A47B 2200/0056* (2013.01)

(58) Field of Classification Search
CPC ..... F16H 2025/2084; F16H 25/20; F16H 25/204; F16H 2025/2053; A47B 9/04; A47B 9/20; A47B 21/02; A47B 2200/0054
See application file for complete search history.

(56) References Cited

U.S. PATENT DOCUMENTS

| | | | | |
|---|---|---|---|---|
| 7,495,359 | B2 * | 2/2009 | Klinke | A47B 9/04 310/51 |
| 8,635,922 | B2 * | 1/2014 | Prottengeier | A47B 9/04 74/89.23 |
| 9,018,813 | B2 * | 4/2015 | Randlov | A47B 9/04 108/20 |
| 9,859,774 | B2 * | 1/2018 | Klinke | A47B 9/04 |
| 10,004,326 | B2 * | 6/2018 | Randlov | A47B 9/20 |
| 10,094,456 | B2 * | 10/2018 | Hu | F16H 25/20 |
| 10,436,242 | B2 * | 10/2019 | Hu | A47B 9/04 |
| 10,524,564 | B1 * | 1/2020 | Wu | A47B 9/20 |
| 2002/0043597 | A1 * | 4/2002 | Forsberg | A47B 9/04 248/188.8 |
| 2011/0174101 | A1 * | 7/2011 | Prottengeier | A47B 9/04 74/110 |
| 2016/0047446 | A1 * | 2/2016 | Hung | F16H 25/2056 74/89.35 |
| 2018/0140087 | A1 * | 5/2018 | Wu | A47B 9/20 |
| 2018/0172062 | A1 * | 6/2018 | Hu | H02K 7/06 |
| 2018/0303233 | A1 * | 10/2018 | DeGroot | A47B 9/20 |
| 2019/0357668 | A1 * | 11/2019 | Knudtson | A47C 3/40 |
| 2019/0374023 | A1 * | 12/2019 | Allen | A47B 17/02 |

* cited by examiner

*Primary Examiner* — Bradley Duckworth
(74) *Attorney, Agent, or Firm* — Leong C. Lei

(57) ABSTRACT

An adjustable table leg which includes an inner lead screw linking an inner lead screw nut to move an outer lead screw nut along an outer lead screw, so that the inner lead screw nut drives a lead screw outer pipe to link a leg middle pipe and the outer lead screw nut to drive a lead screw inner pipe to move an leg outer pipe up and down synchronously. Therefore, the upward and downward transmission is more stable, the upward and downward adjustment is smoother, the phenomenon of jamming does not occur, the adjustment precision is higher, the stress of the inner lead screw nut and the outer lead screw nut is more uniform, the fatigue degree is reduced, and the service life is increased.

9 Claims, 7 Drawing Sheets

ADJUSTABLE TABLE LEG

BACKGROUND OF THE INVENTION

1. Field of the Invention

The present invention relates to a table, and more particularly to an adjustable table leg.

2. Description of the Prior Art

A table is very common office equipment in the office. Most office tables are fixed and cannot be adjusted. They can't adapt to the changes in the office environment and the needs of the users. This makes the staff feel tired during work time and the office resources are not used effectively. Therefore, an adjustable table is developed accordingly. Most of conventional adjustable tables drive a lead screw through a motor to realize the upward and downward adjustment of the table. Due to the poor rationality of the structural design, the transmission of the lifting structure is unstable, and the stress of the linkage structure is excessive, resulting in fatigue and other issues. Moreover, the installation of the conventional adjustable table leg structure is troublesome, which limits the manufacturing efficiency.

Accordingly, the inventor of the present invention has devoted himself based on his many years of practical experiences to solve these problems.

SUMMARY OF THE INVENTION

In view of the drawbacks of the prior art, the primary object of the present invention is to provide an adjustable table leg. The structural design of which is ingenious and reasonable so as to solve the problems that the transmission structure of the prior art is unstable, and the stress of the linkage structure is too large, and it is easy to appear fatigue and other issues.

In order to achieve the above object, the present invention adopts the following technical solutions:

An adjustable table leg comprises a leg outer pipe, a leg middle pipe, a lead screw outer pipe, a lead screw inner pipe, an outer lead screw, an inner lead screw, an outer lead screw nut, an inner lead screw nut, a motor casing, and a drive motor.

The drive motor is mounted in the motor casing. An upper end of the inner lead screw is connected to the drive motor. A lower end of the inner lead screw is located in the outer lead screw. The lead screw outer pipe is configured to wrap the lead screw inner pipe. The leg middle pipe is configured to wrap the lead screw outer pipe. The leg outer pipe is configured to wrap the leg middle pipe. The outer lead screw nut is disposed outside the outer lead screw. The inner lead screw nut is disposed outside the inner lead screw. An upper end of the outer lead screw is connected with a first bearing. One end of the first bearing is connected to the inner lead screw nut. Another end of the first bearing is located above the outer lead screw nut. The inner lead screw is further connected with an inner lead screw guiding block. The inner lead screw guiding block is connected to the outer lead screw so that the outer lead screw, the inner lead screw guiding block and the inner lead screw are rotated synchronously.

One end of the lead screw outer pipe is connected to the inner lead screw nut. Another end of the lead screw outer pipe is connected to the leg middle pipe through a lead screw outer pipe fixing seat. One end of the lead screw inner pipe is connected to the outer lead screw nut. Another end of the lead screw inner pipe is connected with a lead screw inner pipe fixing seat. The leg outer pipe is connected to the lead screw inner pipe fixing seat through a connecting plate.

When the table leg is adjusted up and down, the drive motor drives the inner lead screw to rotate, and the inner lead screw drives the inner lead screw nut to move up and down along the inner lead screw relative to the motor casing, and the inner lead screw nut links the lead screw outer pipe to move up and down relative to the motor casing, and the lead screw outer pipe through the lead screw outer pipe fixing seat links the leg middle pipe to move up and down synchronously relative to the motor casing; meanwhile, the inner lead screw drives the inner lead screw guiding block to rotate, and the inner lead screw guiding block drives the outer lead screw to rotate, and the outer lead screw drives the outer lead screw nut to move up and down along the outer lead screw relative to the motor casing, and the outer lead screw nut links the lead screw inner pipe to move up and down relative to the motor casing, and the lead screw inner pipe links the leg outer pipe to move up and down synchronously relative to the motor casing through the lead screw inner pipe fixing seat and the connecting plate.

Preferably, a leg inner pipe is provided in the leg middle pipe. The leg inner pipe is configured to wrap the lead screw outer pipe. One end of the leg inner pipe is connected to the motor casing.

Preferably, the first bearing is mounted on a first bearing fixing seat. The upper end of the outer lead screw is provided with an annular limiting groove. Upper and lower ends of the annular limiting groove have a first limiting surface and a second limiting surface, respectively. Upper and lower ends of the first bearing abut the first limiting surface and the second limiting surface, respectively. An outer sidewall of the first bearing is exposed outside the annular limiting groove. An inner side of the first bearing fixing seat has a positioning step. The outer side wall of the first bearing is positioned at the positioning step. An upper end of the first bearing fixing seat is fixedly connected to the inner lead screw nut. A lower end of the first bearing fixing seat is located above the outer lead screw nut.

Preferably, the upper end of the inner lead screw is connected with a second bearing. The second bearing is mounted on a second bearing fixing seat. One end of the second bearing fixing seat is connected to the motor casing. Another end of the second bearing fixing seat abuts against the inner lead screw nut.

Preferably, the upper end of the inner lead screw is further connected with a lead screw engaging disk. A lead screw assembly fixing plate is disposed outside the lead screw engaging disk. The lead screw assembly fixing plate is mounted in the motor casing. The lead screw assembly fixing plate is provided with a through hole. One end of the lead screw engaging disk is located in the motor casing. Another end of the lead screw engaging disk passes through the through hole to abut against the second bearing.

Preferably, a first leg spacing frame is connected to one end of the leg outer pipe. An outer side wall and an inner side wall of the first leg spacing frame are attached to an inner side wall of the leg outer pipe and an outer side wall of the leg middle pipe, respectively. A second leg spacing frame is connected to one end of the leg middle pipe. An outer side wall and an inner side wall of the second leg spacing frame are attached to an inner side wall of the leg middle pipe and an outer side wall of the leg inner pipe, respectively.

Preferably, an outer side wall of the inner lead screw guiding block is provided with a plurality of guiding ribs. An inner side wall of the outer lead screw is provided with a plurality of guiding grooves. The guiding ribs are fitted in the corresponding guiding grooves.

Preferably, an outer lead screw stopper is connected to a lower end of the outer lead screw. The outer lead screw stopper includes a first portion and a second portion connected to each other. The first portion and the second portion each have a first connecting end and a second connecting end. The first connecting end and the second connecting end are a connecting hole and a connecting post, respectively. The connecting post is fitted into the corresponding connecting hole.

Preferably, the end of the leg inner pipe is connected with two first leg long spacers and two first leg short spacers. The two first leg long spacers and the two first leg short spacers are all mounted on an outer side of the leg inner pipe. The first leg long spacers and the first leg short spacers are arranged on the leg inner pipe in an alternating manner.

Preferably, one end of the leg middle pipe, connected to the lead screw outer pipe fixing seat, is connected with two second leg long spacers and two second leg short spacers. The two second leg long spacers and the two second leg short spacers are all mounted on an outer side of the leg middle pipe. The second leg long spacer and the second leg short spacer are arranged on the leg middle pipe in an alternating manner. A positioning post is disposed on one side of each of the two second leg long spacers and the two second leg short spacers. The positioning post passes through the leg middle pipe and is engaged in an engaging hole of the lead screw outer pipe fixing seat.

The present invention has obvious advantages and beneficial effects compared with the prior art, in particular, it can be known from the above technical solutions. The inner lead screw links the inner lead screw nut to move the outer lead screw nut along the outer lead screw, so that the inner lead screw nut drives the lead screw outer pipe to link the leg middle pipe and the outer lead screw nut to drive the lead screw inner pipe to move the leg outer pipe up and down synchronously. Therefore, the upward and downward transmission is more stable, the upward and downward adjustment is smoother, the phenomenon of jamming does not occur, the adjustment precision is higher, the stress of the inner lead screw nut and the outer lead screw nut is more uniform, the fatigue degree is reduced, and the service life is increased. In particular, its structural design is ingenious, the overall layout is reasonable, and the installation is simple.

DETAILED DESCRIPTION OF THE PREFERRED EMBODIMENTS

Figure 1:
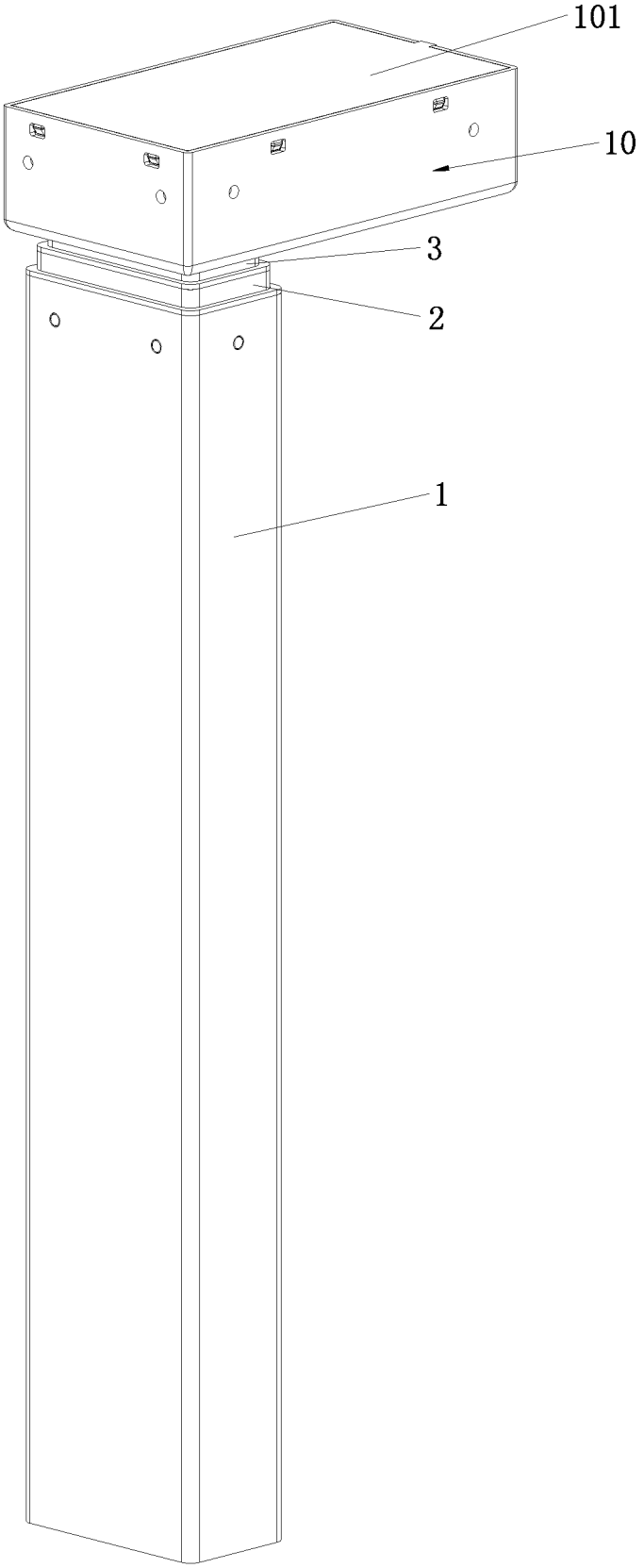
FIG. 1 is a structural schematic view according to an embodiment of the present invention (in a retracted state)
Figure 2:
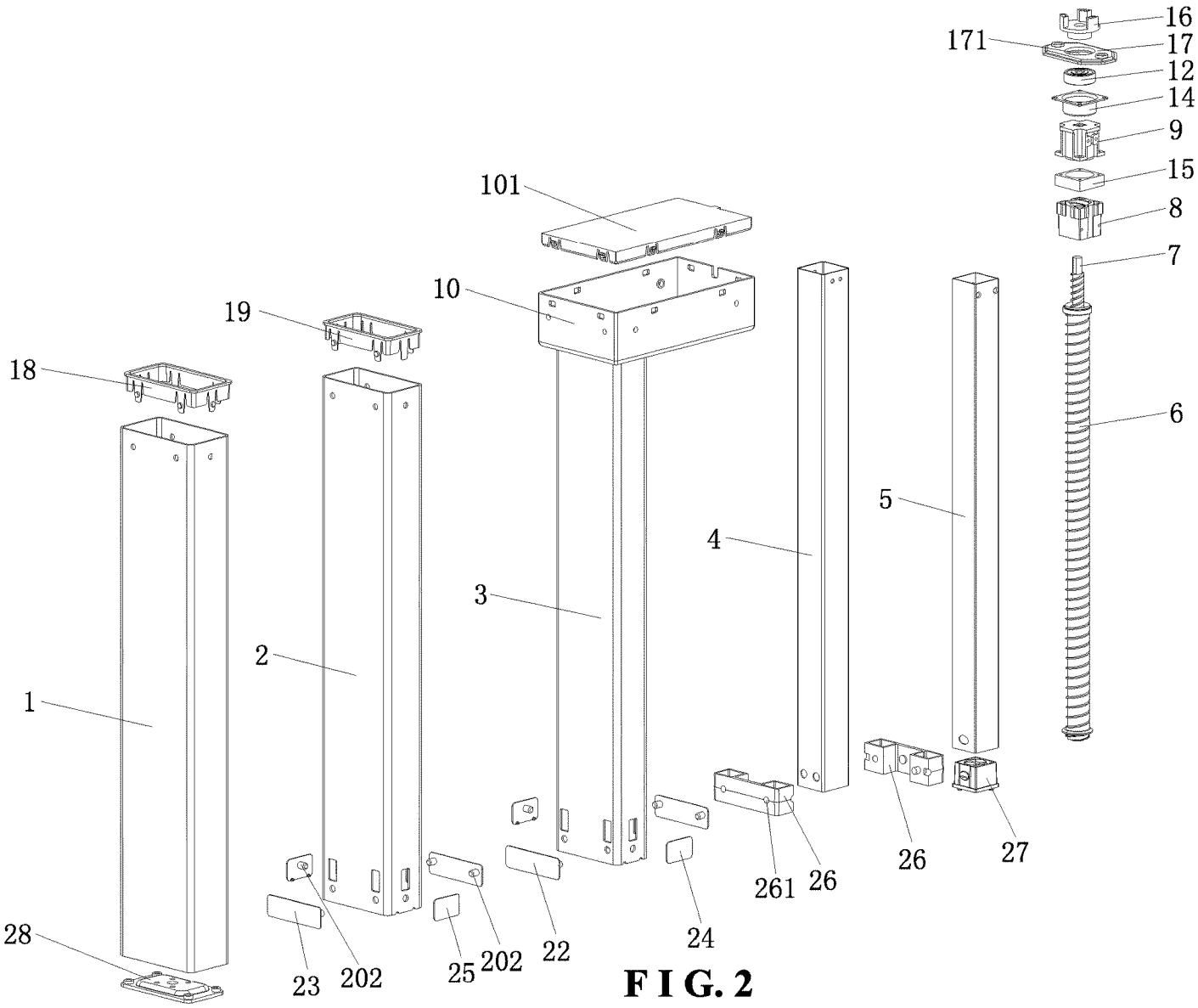
FIG. 2 is an exploded view according to the embodiment of the present invention.
Figure 3:
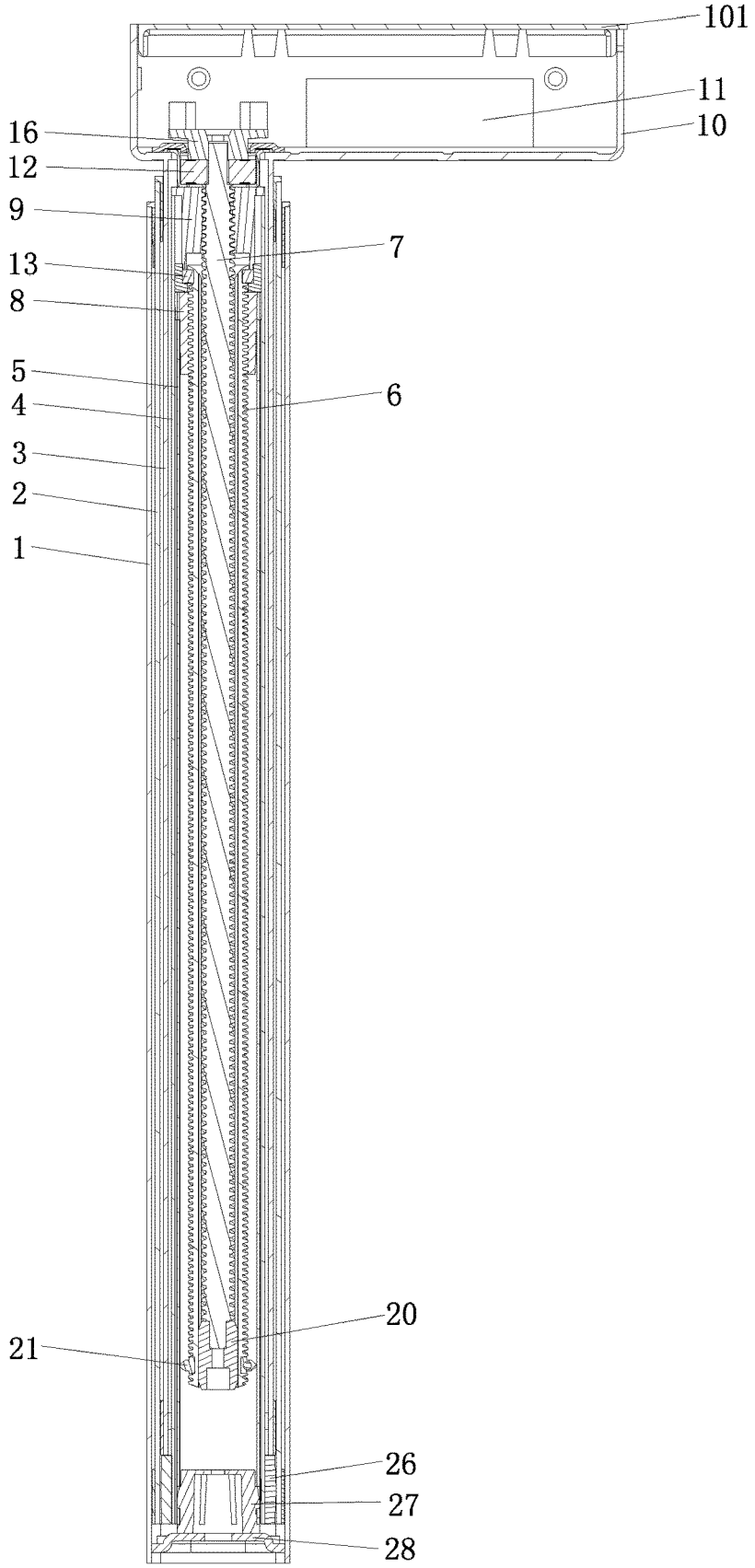
FIG. 3 is a cross-sectional view according to the embodiment of the present invention (in a retracted state)
Figure 4:
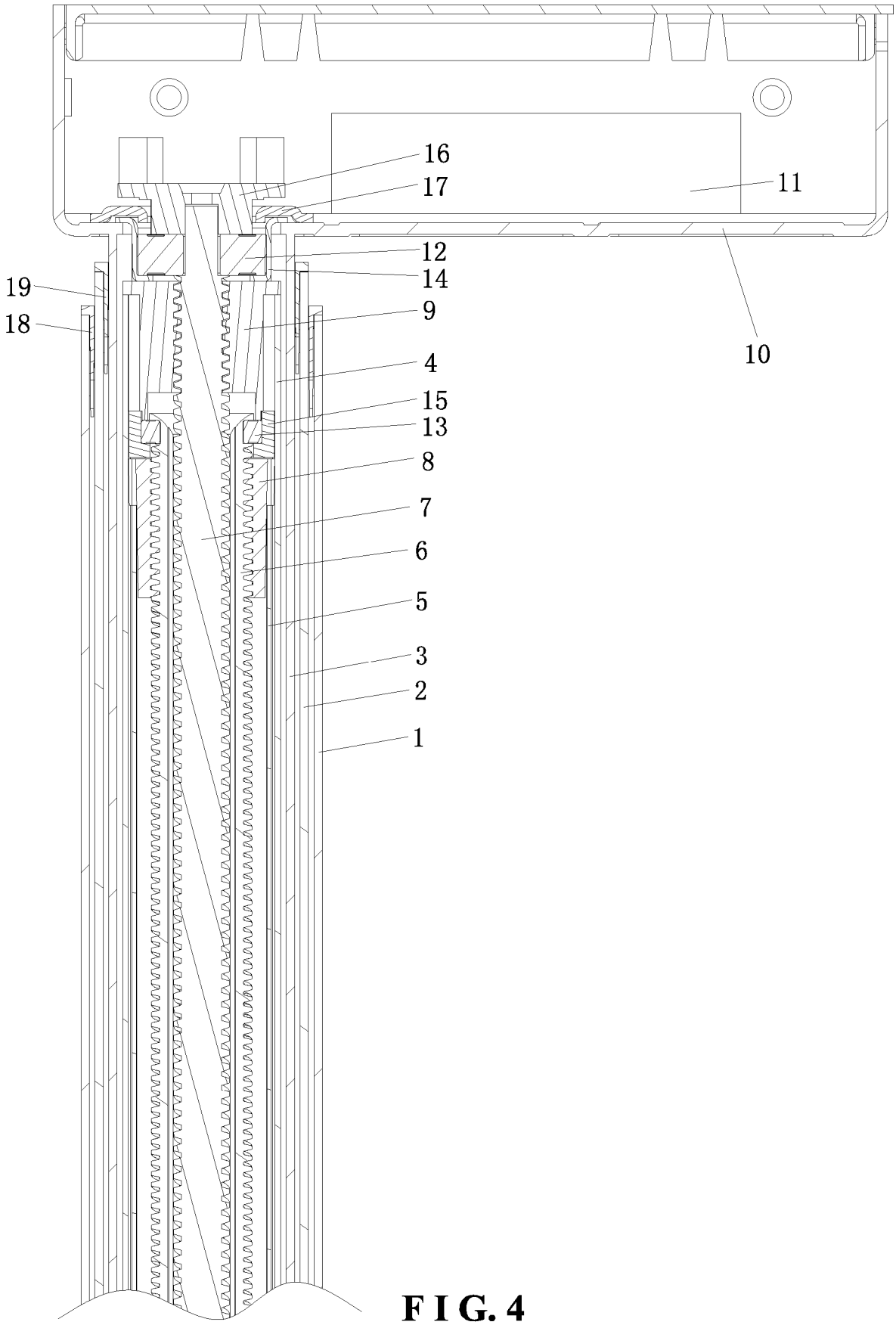
FIG. 4 is a partial structural view of FIG. 3.
Figure 5:
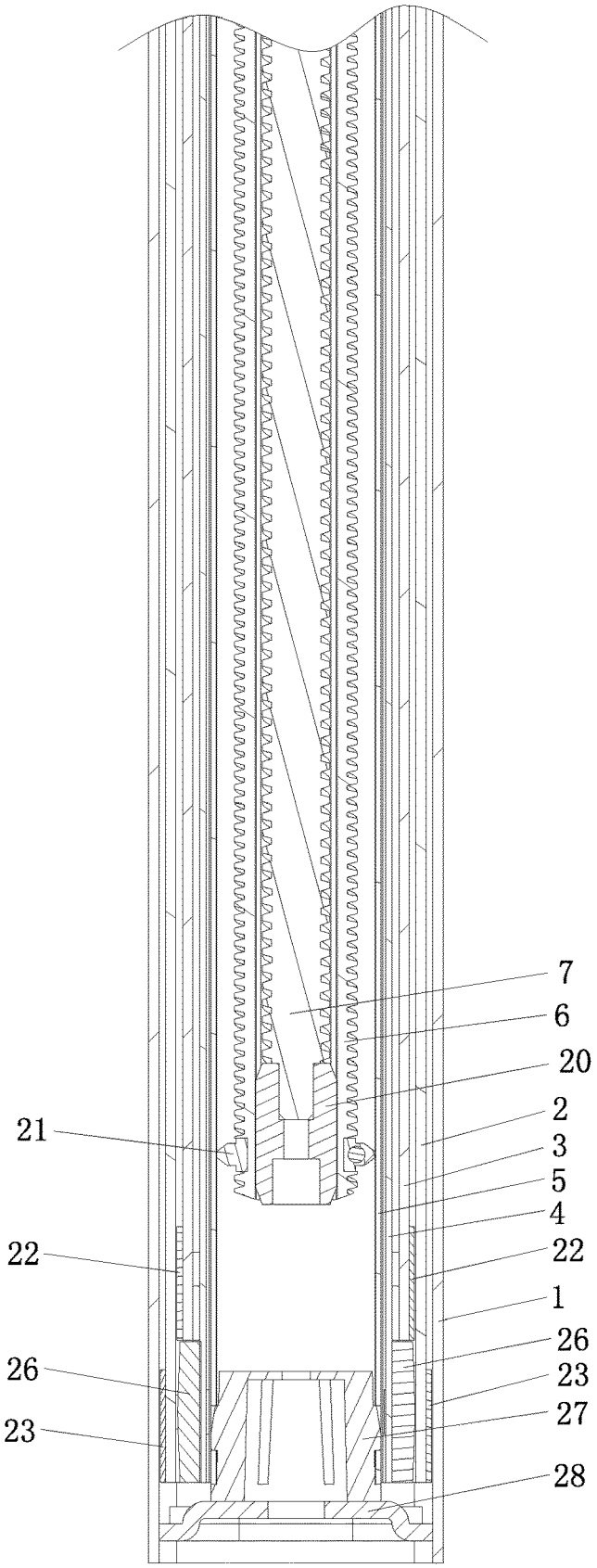
FIG. 5 is another partial structural view of FIG. 3.
Figure 6:
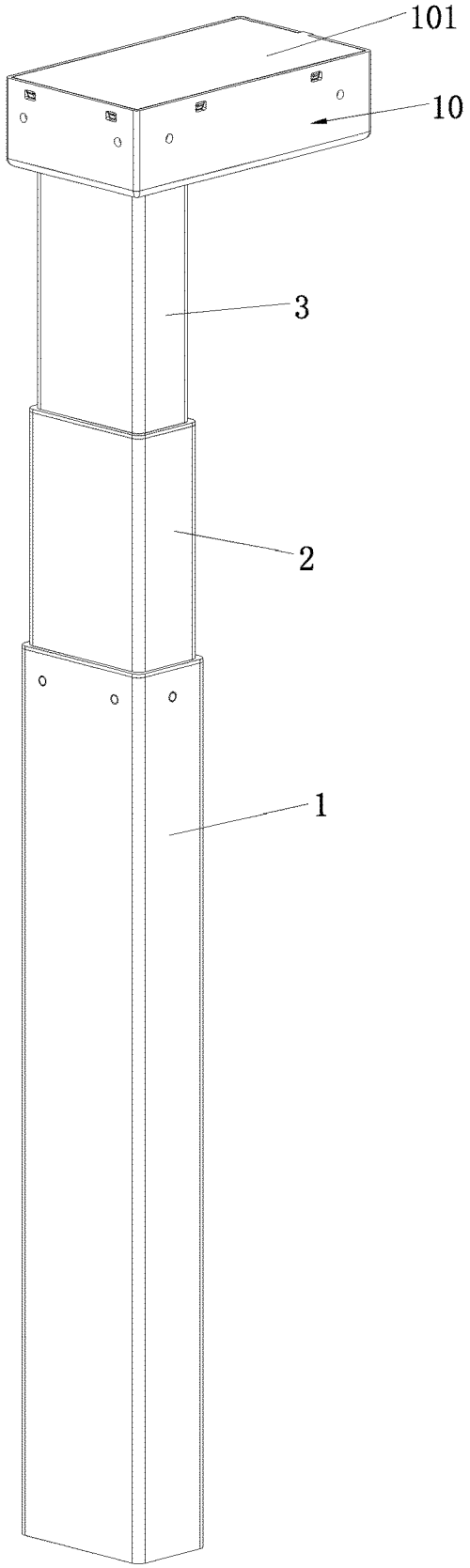
FIG. 6 is a schematic view according to the embodiment of the present invention (in an extended state)
Figure 7:
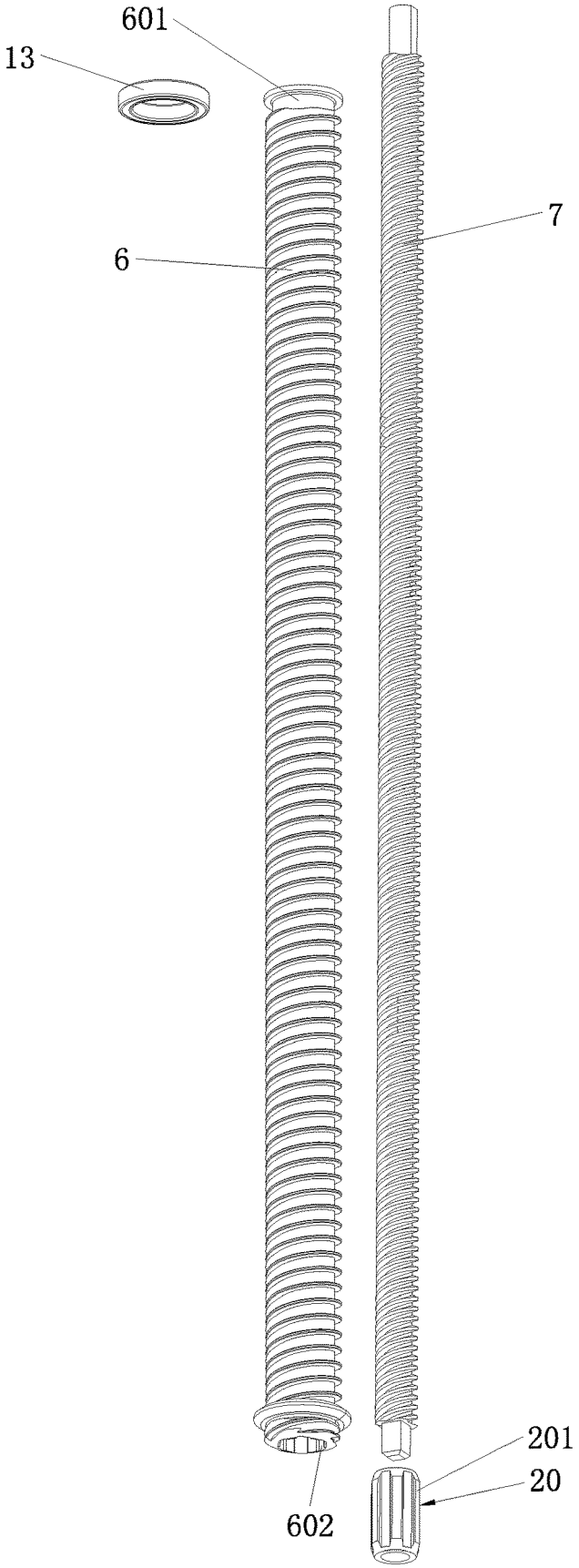
FIG. 7 is a partially exploded view of the embodiment of the present invention.

Please refer to FIG. 1 to FIG. 7, which shows a specific structure of an embodiment of the present invention; it is mainly applied to an office table, but is not limited to an office table, and may be applied to a desk, a dining table, and the like.

Spatially relative terms, such as "upper," "lower," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. Therefore, it should not be construed as limiting the invention.

An adjustable table leg in accordance with an embodiment of the present invention comprises a leg outer pipe 1, a leg middle pipe 2, a lead screw outer pipe 4, a lead screw inner pipe 5, an outer lead screw 6, an inner lead screw 7, an outer lead screw nut 8, an inner lead screw nut 9, a motor casing 10, and a drive motor 11. The drive motor 11 is mounted in the motor casing 10. The motor casing 10 has a motor cover 101. An upper end of the inner lead screw 7 is connected to the drive motor 11, and a lower end of the inner lead screw 7 is located in the outer lead screw 6. The lead screw outer pipe 4 is configured to wrap the lead screw inner pipe 5. The leg middle pipe 2 is configured to wrap the lead screw outer pipe 4. The leg outer pipe 1 is configured to wrap the leg middle pipe 2. The outer lead screw nut 8 is disposed outside the outer lead screw 6. The inner lead screw nut 9 is disposed outside the inner lead screw 7. An upper end of the outer lead screw 6 is connected with a first bearing 13. One end of the first bearing 13 is connected to the inner lead screw nut 9, and another end of the first bearing 13 is located above the outer lead screw nut 8. The inner lead screw 7 is further connected with an inner lead screw guiding block 20, and the inner lead screw guiding block 20 is connected to the outer lead screw 6, so that the outer lead screw 6, the inner lead screw guiding block 20 and the inner lead screw 7 are rotated synchronously. A leg inner pipe 3 is provided in the leg middle pipe 2. The leg inner pipe 3 is configured to wrap the lead screw outer pipe 4. A first end of the leg inner pipe 3 is connected to the motor casing 10. In this embodiment, the leg inner pipe 3 is integrally connected with the motor casing 10. One end of the lead screw outer pipe 4 is connected to the inner lead screw nut 9, and another end of the lead screw outer pipe 4 is connected to the leg middle pipe 2 through a lead screw outer pipe fixing seat 26. A first end of the lead screw inner pipe 5 is connected to the outer lead screw nut 8. A second end of the lead screw inner pipe 5 is connected with a lead screw inner pipe fixing seat 27. The leg outer pipe 1 is connected to the lead screw inner pipe fixing seat 27 through a connecting plate 28.

Wherein, the upper end of the inner lead screw 7 is connected with a second bearing 12. The second bearing 12 is mounted on a second bearing fixing seat 14. One end of the second bearing fixing seat 14 is connected to the motor casing 10, and another end of the second bearing fixing seat 14 abuts against the inner lead screw nut 9. The upper end of the inner lead screw 7 is further connected with a lead screw engaging disk 16. A lead screw assembly fixing plate 17 is disposed outside the lead screw engaging disk 16. The lead screw assembly fixing plate 17 is mounted in the motor casing 10. The lead screw assembly fixing plate 17 is provided with a through hole 171. One end of the lead screw engaging disk 16 is located in the motor casing 10, and another end of the lead screw engaging disk 16 passes through the through hole 171 to abut against the second bearing 12.

The first bearing 13 is mounted on a first bearing fixing seat 15. The upper end of the outer lead screw 6 is provided with an annular limiting groove 601. The upper and lower ends of the annular limiting groove 601 have a first limiting surface and a second limiting surface, respectively. The upper and lower ends of the first bearing 13 abut the first limiting surface and the second limiting surface, respectively. The outer sidewall of the first bearing 13 is exposed outside the annular limiting groove 601. The inner side of the first bearing fixing seat 15 has a positioning step. The outer side wall of the first bearing 13 is positioned at the positioning step. The upper end of the first bearing fixing seat 15 is fixedly connected to the inner lead screw nut 9, and the lower end of the first bearing fixing seat 15 is located above the outer lead screw nut 8. Thereby, the linkage between the inner lead screw nut 9 and the outer lead screw 6 can ensure the synchronous movement of the same track between the inner lead screw nut 9 and the outer lead screw 6 when moved up and down.

A first leg spacing frame 18 is connected to the upper end of the leg outer pipe 1. The outer side wall and the inner side wall of the first leg spacing frame 18 are attached to the inner side wall of the leg outer pipe 1 and the outer side wall of the leg middle pipe 2, respectively. A second leg spacing frame 19 is connected to the upper end of the leg middle pipe 2. The outer side wall and the inner side wall of the second leg spacing frame 19 are attached to the inner side wall of the leg middle pipe 2 and the outer side wall of the leg inner pipe 3, respectively. The first leg spacing frame 18 and the second leg spacing frame 19 can effectively ensure the intervals between the leg outer pipe 1, the leg middle pipe 2, and the leg inner pipe 3, thereby facilitating the upward movement and the downward movement of the table leg.

In this embodiment, preferably, the inner lead screw guiding block 20 is connected to the lower end of the inner lead screw 7 so that the stroke of the outer lead screw 6 relative to the inner lead screw 7 is sufficiently long to avoid a waste of the length of the lead screw. The outer side wall of the inner lead screw guiding block 20 is provided with a plurality of guiding ribs 201. Correspondingly, the inner side wall of the outer lead screw 6 is provided with a plurality of guiding grooves 602. The guiding ribs 201 are fitted in the corresponding guiding grooves 602. The plurality of guiding ribs 201 are vertically protruded from the outer side wall of the inner lead screw guiding block 20. The plurality of guiding grooves 602 are vertically recessed on the inner side wall of the outer lead screw 6.

An outer lead screw stopper 21 is connected to the lower end of the outer lead screw 6. The outer lead screw stopper 21 includes a first portion and a second portion connected to each other. The first portion and the second portion each have a first connecting end and a second connecting end. The first connecting end and the second connecting end are a connecting hole and a connecting post, respectively. The connecting post is fitted into the corresponding connecting hole.

In addition, in the embodiment, the upper end of the leg inner pipe 3 is connected with two first leg long spacers 22 and two first leg short spacers 24. The two first leg long spacers 22 and the two first leg short spacers 24 are all mounted on the outer side of the leg inner pipe 3. The first leg long spacers 22 and the first leg short spacers 24 are arranged on the leg inner pipe 3 in an alternating manner. One end of the leg middle pipe 2, connected to the lead screw outer pipe fixing seat 26, is connected with two second leg long spacers 23 and two second leg short spacers 25. The two second leg long spacers 23 and the two second leg short spacers 25 are all mounted on the outer side of the leg middle pipe 2. The second leg long spacer 23 and the second leg short spacer 25 are arranged on the leg middle pipe 2 in an alternating manner. A positioning post 202 is disposed on one side of each of the two second leg long spacers 23 and the two second leg short spacers 25. The positioning post 2022 passes through the leg middle pipe 2 and is engaged in an engaging hole 261 of the lead screw outer pipe fixing seat 26. Thereby, the arrangement of the two first leg long spacers 22, the two first leg short spacers 24, the two second leg long spacers 23 and the two second leg short spacers 25 can effectively ensure the intervals between the leg outer pipe 1, the leg middle pipe 2, and the leg inner pipe 3, thereby facilitating the upward movement and the downward movement of the table leg. Besides, the positioning post 202 is inserted into the engaging hole 261 of the lead screw outer pipe fixing seat 26, so that the leg middle pipe 2 and the lead screw outer pipe 4 can be stably connected together to move upwardly and downwardly simultaneously. The snap-type positioning structure is simple and easy for installation.

The working principle of the present invention is as follows:

When the table leg is adjusted up and down, the drive motor 11 drives the inner lead screw 7 to rotate, and the inner lead screw 7 drives the inner lead screw nut 9 to move up and down along the inner lead screw 7 relative to the motor casing 10, and the inner lead screw nut 9 links the lead screw outer pipe 4 to move up and down relative to the motor casing 10, and the lead screw outer pipe 4 through the lead screw outer pipe fixing seat 26 links the leg middle pipe 2 to move up and down synchronously relative to the motor casing 10; meanwhile, the inner lead screw 7 drives the inner lead screw guiding block 20 to rotate, and the inner lead screw guiding block 20 drives the outer lead screw 6 to rotate, and the outer lead screw 6 drives the outer lead screw nut 8 to move up and down along the outer lead screw 6 relative to the motor casing 10, and the outer lead screw nut 8 links the lead screw inner pipe 5 to move up and down relative to the motor casing 10, and the lead screw inner pipe 5 links the leg outer pipe 1 to move up and down synchronously relative to the motor casing 10 through the lead screw inner pipe fixing seat 27 and the connecting plate 28.

Although particular embodiments of the present invention have been described in detail for purposes of illustration, various modifications and enhancements may be made without departing from the spirit and scope of the present invention. Accordingly, the present invention is not to be limited except as by the appended claims

What is claimed is:

1. An adjustable table leg, comprising a leg outer pipe, a leg middle pipe, a lead screw outer pipe, a lead screw inner pipe, an outer lead screw, an inner lead screw, an outer lead screw nut, an inner lead screw nut, a motor casing, and a drive motor;

the drive motor being mounted in the motor casing; an upper end of the inner lead screw being connected to the drive motor, a lower end of the inner lead screw being located in the outer lead screw; the lead screw outer pipe being configured to wrap the lead screw inner pipe, the leg middle pipe being configured to wrap the lead screw outer pipe, the leg outer pipe being configured to wrap the leg middle pipe, the outer lead screw nut being disposed outside the outer lead screw, the inner lead screw nut being disposed outside the inner lead screw; an upper end of the outer lead screw being connected with a first bearing; one end of the first bearing being connected to the inner lead screw nut, another end of the first bearing being located above the outer lead screw nut; the inner lead screw being further connected with an inner lead screw guiding block, the inner lead screw guiding block being connected to the outer lead screw so that the outer lead screw, the inner lead screw guiding block and the inner lead screw are rotated synchronously;

one end of the lead screw outer pipe being connected to the inner lead screw nut, another end of the lead screw outer pipe being connected to the leg middle pipe through a lead screw outer pipe fixing seat, one end of the lead screw inner pipe being connected to the outer lead screw nut, another end of the lead screw inner pipe being connected with a lead screw inner pipe fixing seat, the leg outer pipe being connected to the lead screw inner pipe fixing seat through a connecting plate;

wherein when the table leg is adjusted up and down, the drive motor drives the inner lead screw to rotate, and the inner lead screw drives the inner lead screw nut to move up and down along the inner lead screw relative to the motor casing, and the inner lead screw nut links the lead screw outer pipe to move up and down relative to the motor casing, and the lead screw outer pipe through the lead screw outer pipe fixing seat links the leg middle pipe to move up and down synchronously relative to the motor casing; meanwhile, the inner lead screw drives the inner lead screw guiding block to rotate, and the inner lead screw guiding block drives the outer lead screw to rotate, and the outer lead screw drives the outer lead screw nut to move up and down along the outer lead screw relative to the motor casing, and the outer lead screw nut links the lead screw inner pipe to move up and down relative to the motor casing, and the lead screw inner pipe links the leg outer pipe to move up and down synchronously relative to the motor casing through the lead screw inner pipe fixing seat and the connecting plate wherein an outer lead screw stopper is connected to a lower end of the outer lead screw, the outer lead screw stopper includes a first portion and a second portion connected to each other, the first portion and the second portion each have a first connecting end and a second connecting end, the first connecting end and the second connecting end are a connecting hole and a connecting post respectively, and the connecting post is fitted into the corresponding connecting hole.

2. The adjustable table leg as claimed in claim 1, wherein a leg inner pipe is provided in the leg middle pipe, the leg inner pipe is configured to wrap the lead screw outer pipe, and one end of the leg inner pipe is connected to the motor casing.

3. The adjustable table leg as claimed in claim 2, wherein a first leg spacing frame is connected to one end of the leg outer pipe, an outer side wall and an inner side wall of the first leg spacing frame are attached to an inner side wall of the leg outer pipe and in contact with an outer side wall of the leg middle pipe, respectively; a second leg spacing frame is connected to one end of the leg middle pipe, an outer side wall and an inner side wall of the second leg spacing frame are attached to an inner side wall of the leg middle pipe and an outer side wall of the leg inner pipe, respectively.

4. The adjustable table leg as claimed in claim 2, wherein the end of the leg inner pipe is connected with two first leg long spacers and two first leg short spacers, the two first leg long spacers and the two first leg short spacers are all mounted on an outer side of the leg inner pipe, the first leg long spacers and the first leg short spacers are arranged on the leg inner pipe in an alternating manner.

5. The adjustable table leg as claimed in claim 1, wherein the first bearing is mounted on a first bearing fixing seat; the upper end of the outer lead screw is provided with an annular limiting groove, upper and lower ends of the annular limiting groove have a first limiting surface and a second limiting surface respectively; upper and lower ends of the first bearing abut the first limiting surface and the second limiting surface respectively; an outer sidewall of the first bearing is exposed outside the annular limiting groove, an inner side of the first bearing fixing seat has a positioning step, the outer side wall of the first bearing is positioned at the positioning step; an upper end of the first bearing fixing seat is fixedly connected to the inner lead screw nut, and a lower end of the first bearing fixing seat is located above the outer lead screw nut.

6. The adjustable table leg as claimed in claim 1, wherein the upper end of the inner lead screw is connected with a second bearing, the second bearing is mounted on a second bearing fixing seat, one end of the second bearing fixing seat is connected to the motor casing, and another end of the second bearing fixing seat abuts against the inner lead screw nut.

7. The adjustable table leg as claimed in claim 6, wherein the upper end of the inner lead screw is further connected with a lead screw engaging disk, a lead screw assembly fixing plate is disposed outside the lead screw engaging disk, the lead screw assembly fixing plate is mounted in the motor casing; the lead screw assembly fixing plate is provided with a through hole, one end of the lead screw engaging disk is located in the motor casing, and another end of the lead screw engaging disk passes through the through hole to abut against the second bearing.

8. The adjustable table leg as claimed in claim 1, wherein an outer side wall of the inner lead screw guiding block is provided with a plurality of guiding ribs; an inner side wall of the outer lead screw is provided with a plurality of guiding grooves, and the guiding ribs are fitted in the corresponding guiding grooves.

9. The adjustable table leg as claimed in claim 1, wherein one end of the leg middle pipe, connected to the lead screw outer pipe fixing seat, is connected with two second leg long spacers and two second leg short spacers, the two second leg long spacers and the two second leg short spacers are all mounted on an outer side of the leg middle pipe, the second leg long spacer and the second leg short spacer are arranged on the leg middle pipe in an alternating manner; a positioning post is disposed on one side of each of the two second leg long spacers and the two second leg short spacers, the positioning post passes through the leg middle pipe and is engaged in an engaging hole of the lead screw outer pipe fixing seat.

* * * * *